United States Patent [19]

Joseph

[11] 4,113,131

[45] Sep. 12, 1978

[54] WIRE-NETTING BASKETS, BASKET HEIGHTENING DEVICES AND THE LIKE

[75] Inventor: Raymond Joseph, Schiltigheim, France

[73] Assignee: Ateliers Reunis Societe Anonyme, Schiltigheim, France

[21] Appl. No.: 815,366

[22] Filed: Jul. 13, 1977

[51] Int. Cl.[2] ..... B65D 7/20; B65D 7/00; B65D 7/24

[52] U.S. Cl. ..... 220/19; 220/4 F; 220/7

[58] Field of Search ..... 220/19, 1.5, 76, 4 F, 220/7

[56] References Cited

U.S. PATENT DOCUMENTS

| | | | |
|---|---|---|---|
| 3,093,261 | 6/1963 | Salat | 220/19 |
| 3,420,483 | 1/1969 | Stalker | 220/19 X |
| 3,762,593 | 10/1973 | Beretta | 220/19 X |
| 4,023,698 | 5/1977 | Joseph | 220/19 X |

*Primary Examiner*—William Price
*Assistant Examiner*—Steven M. Pollard
*Attorney, Agent, or Firm*—Michael J. Striker

[57] ABSTRACT

This receptacle adapted to constitute a wire-netting basket or basket heightening device comprises four lateral panels and possibly a bottom panel, said four panels being provided with interlocking hook means and passages so arranged that when a first panel has been assembled with a pair of adjacent lateral panels the fourth panel can be lowered to its final locking and assembling position to provide a rigid structure free of hinges, pivot means and the like.

5 Claims, 9 Drawing Figures

WIRE-NETTING BASKETS, BASKET HEIGHTENING DEVICES AND THE LIKE

BACKGROUND OF THE INVENTION

1. Field of the Invention

The present invention relates to receptacles such as baskets, basket heightening devices and the like, and more particularly to receptacles of this type of which the lateral panels consist of wirenetting.

2. Description of the Prior Art

As a rule, these panels are welded to one another so that they cannot be folded or disassembled for storage or transport purposes.

To avoid this inconvenience, it has already been proposed to construct receptacles of the type set forth hereinabove wherein the lateral panels are adapted to be folded against one another. However, this construction requires the use of pivot means tending to increase unduly the manufacturing cost of such receptacles. Moreover, some locking means must also be provided for keeping the panels in their spread or operative position, and this also makes the manufacture of receptacles of this character relatively complicated.

SUMMARY OF THE INVENTION

It is therefore the primary object of the present invention to provide a receptacle consisting of panels completely detachable from one another but adapted to be fastened to one another by using particularly simple assembling means. On the other hand, the form of these assembling means is such that the panels provided therewith can be assembled very easily and rapidly by the user of the receptacle.

For this purpose, the receptacle according to this invention is characterized in that one of the lateral panels thereof comprises along its vertical edges hook means adapted to engage matching passages formed in the relevant or registering edges of the two adjacent lateral panels, whereas the panel opposite said one panel comprises at its bottom edges hook means adapted to engage registering passages formed in the lower portion of said adjacent panels when said opposite panel is presented in a upwardly and outwardly inclinded position.

However, the aforesaid pair of lateral panels are also provided at their upper portions with another pair of passages adapted to be engaged by a pair of hooks means provided at the upper corners of this opposite panel and adapted to be anchored to said pair of lateral panels when a downward sliding movement is imparted to said opposite panel.

Upon completion of this last operation the various panels are safely interlocked and constitute a particularly sturdy receptacle. As already mentioned in the foregoing, this receptacle may constitute a basket, a basket heightening device, or the like, as desired. By way of illustration, a typical form of embodiment of the present invention, in the form of a basket constituting a storage rack or bin for potatoes or other vegetables, will now be described with reference to the attached drawing, in which:

DESCRIPTION OF THE PREFERRED EMBODIMENT

Figure 1:
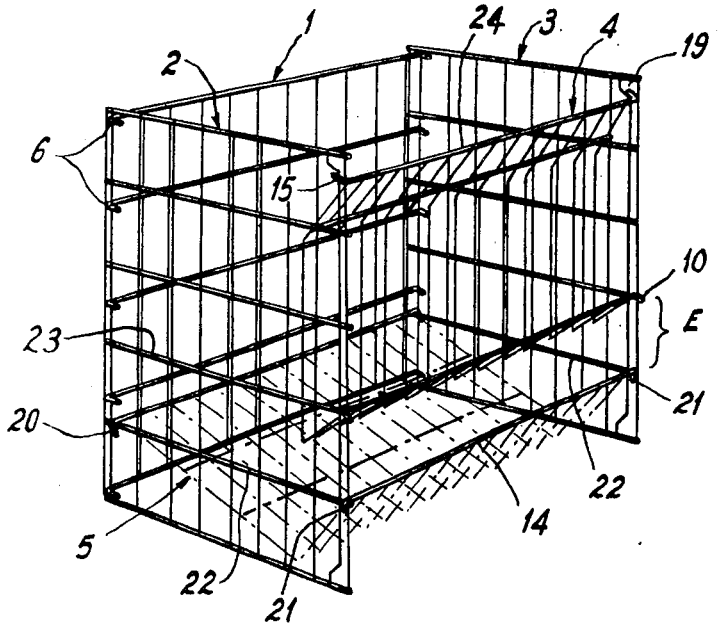
FIG. 1 is a perspective view of the corresponding receptacle shown in its operative or final condition, after assembling the various component elements or panels constituting this basket.

As already mentioned in the foregoing, the wire-netting structure according to this invention is intended for use as a storage bin, rack or receptacle, notably for potatoes or other vegetables. The lateral wall of this receptacle comprises four panels designated by the reference numerals 1, 2, 3 and 4, respectively. However, considering the fact that the receptacle is intended primarily for the storage of goods, it also comprises in the present instance a bottom wall 5. However, the latter may be dispensed with when the receptacle according to this invention is intended for use as a basket heightening device or the like.

In this example the aforesaid four panels consist of welded wire-netting. Panels 2 and 3 are identical with each other and constitute the side panels of the vertical wall of the receptacle. The other panels 1 and 4 constitute the rear panel and the front panel, respectively, of this vertical wall.

The rear panel 1 comprises along its vertical edges a series of hook means 6 extending horizontally and forwardly. These hook means may advantageously consist of the bent end portions of metal-wire cross members 7 forming an integral part of the grid-like panel 1.

Formed in the pair of lateral or side panels 2 and 3, adjacent the rear edge thereof, are passage means adapted to be engaged by the hook means 6 of rear panel 1. More particularly, if these two panels are of wire-netting construction, as in the example illustrated, these passage means consist of the gap left between the rear side 8 of each panel concerned and the adjacent upright 9. Now the width of this gap e1 is by construction smaller than the length of hook means 6 carried by the rear panel 1, so that said hook means can engage the outer face of uprights 9 without any possibility of being inadvertently loosened therefrom, as will be explained presently.

The front panel 4 adapted to be assembled last comprises at its two bottom corners a pair of hook means 10 respectively, which extend forwardly and consist of the end portions of the lower horizontal side 11 of the wire-netting constituting this panel. In connection with this front panel 4, it may be pointed out that in the example illustrated this panel has a somewhat particular configuration, due to the specific purpose for which this panel is intended. Thus, the wire-netting structure constituting this panel 4 comprises a bent upper portion 12 slightly inclined forwardly and a bent lower portion 13 inclined forwardly and upwardly. On the other hand, the height of this panel 4 is such that in its assembled condition it provides a free space E with respect to the front edge 14 of the bottom wall 5 of the corresponding receptacle, this free space E being shaped to permit the picking up of articles contained in the receptacle, notably in the cae of potatoes and like vegetables.

At its two upper corners the front panel 4 is also provided with another pair of rearwardly extending hooks 15. The other two lateral panels 2 and 3 comprise along their front edge 16 passages adapted to be engaged by the hook means 10 and 15 of front panel 4. These passages consist of the gap e2 provided between the front edge 16 of each panel 2 or 3 and the adjacent vertical upright 17. As in the case of the aforesaid gap e1, this gap e2 has a width smaller than the length of hook means 10 provided at the lower corners of front panel 4.

However, at their upper ends an elbow 18 is formed rearwardly in the uprights 17 in order to provide at this location a widened passage 19 adapted to be engaged by the upper hook means 15 of front panel 4.

Figure 3:
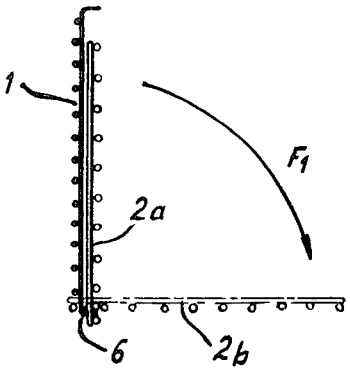
FIGS. 3 and 4 are diagrammatic plane views from above illustrating two successive steps of the method of assembling the lateral panels with the panel of which the vertical edges are provided with retaining hooks.
Figure 4:
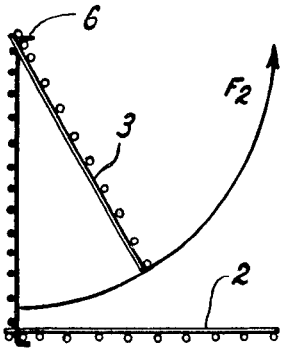

With this arrangement concerning the various panels constituting the vertical lateral wall of the receptacle these panels can be assembled very easily, without resorting to any tool or other assembling accessories. This assembling operation is started by assembling the pair of lateral panels 2, 3 with the rear panel 1. More particularly, one of the lateral panels, for example panel 2, is presented in a position *2a* in which it is substantially parallel to panel 1 (see FIG. 3). Thus, the hook means 6 carried by the vertical edge of panel 1 can be engaged into the passages e1 formed along the rear edge of panel 2. Then this panel 2 is pivoted in the direction of the arrow F1 to its final position *2b*, whereafter the corresponding hook means 6 of the rear panel 1 are engaged into the passages e1 of the rear edge of said panel 2.

It may also be pointed out that the hook means 6 of both vertical edges of rear panel 1 are thus anchored to the outer surface of uprights 9 of the pair of lateral panels 2 and 3. Now, these hook means cannot become loose inadvertently from their corresponding passages since the width of gap e1 is smaller than the length of said passages.

Subsequently, the bottom panel 5 can be fitted in position by means of hook means 20 and 21 provided for this purpose at the front and rear corners of this panel. Then, hook means 20 are engaged between the rear uprights 8 and 9 of the lateral panels so as to anchor them on the lower cross members 22 thereof. Besides, the front hook means 21 are engaged in a similar manner between the front uprights 16 and 17 of the same panels in order to be anchored to the cross members 22 thereof.

Finally, the front panel 4 is positioned in order definitely to lock the various panels with one another and thus obtain a rigid structure.

Figure 9:
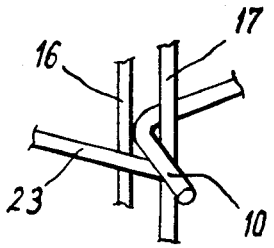
Figure 2:
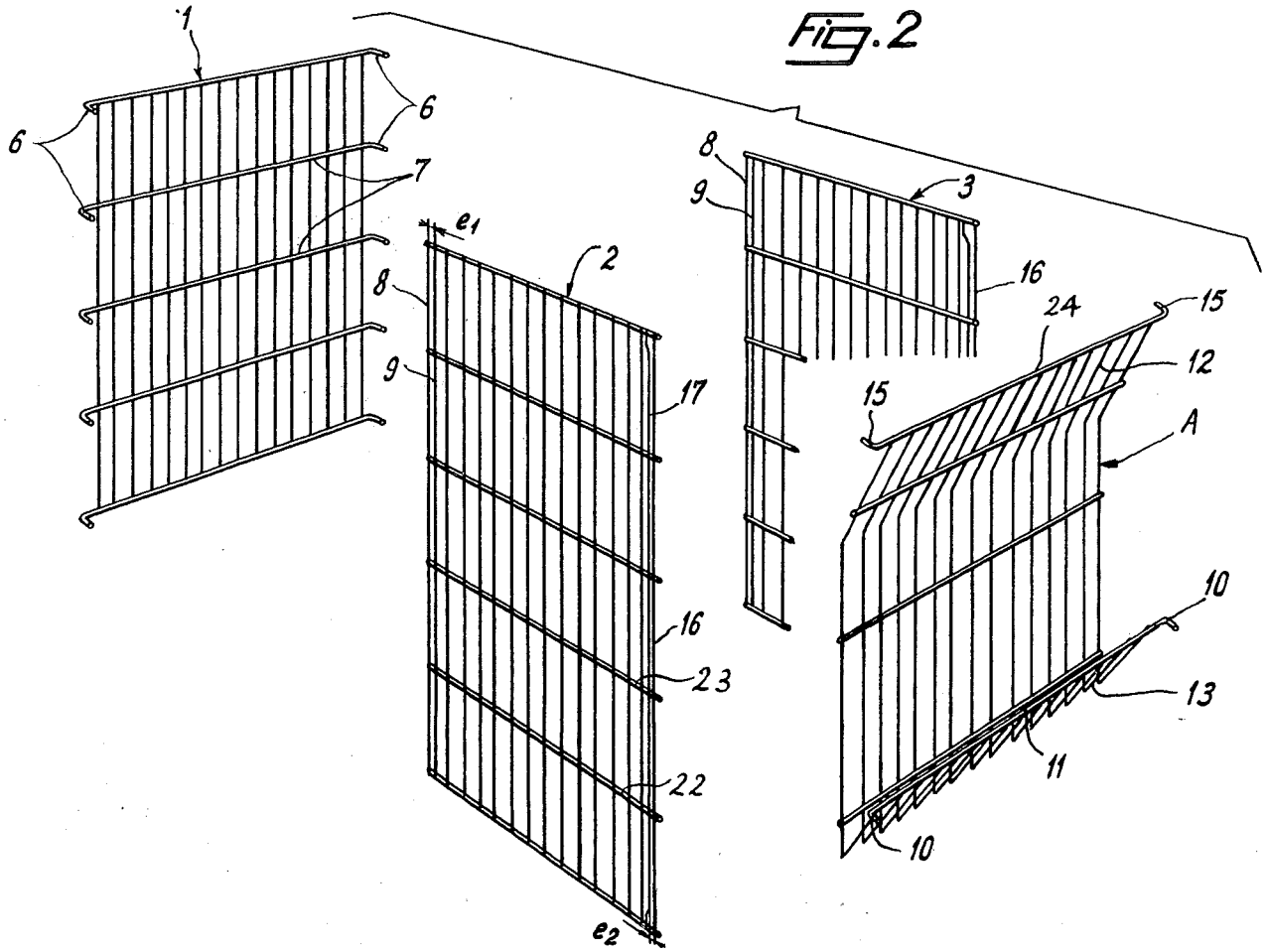
FIG. 2 is another perspective but exploded view showing the various panels constituting the lateral walls of the basket.
Figure 5:
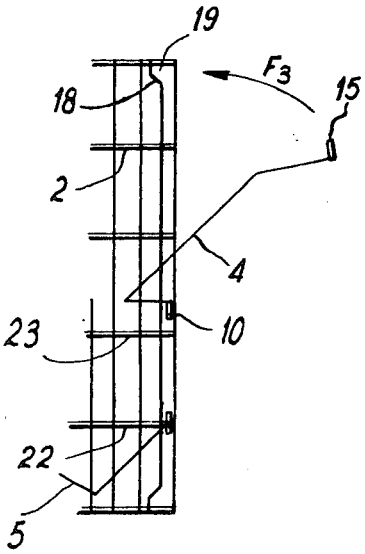
FIGS. 5 to 7 are diagrammatic fragmentary elevational views showing three successive steps of the operation consisting in assembling the last panel of the lateral wall structure of this receptacle.

To this end, the operator firstly presents this panel 4 in a position inclined outwardly as illustrated in FIG. 5, whereby the lower hook means 10 thereof extend vertically downwards and can engage passages e2 formed in the front edges of the pair of panels 2 and 3 above the cross member 23 thereof. These two hook means will thus become locked to the outer surfaces of these two cross members, as shown in FIG. 9.

Figure 6:
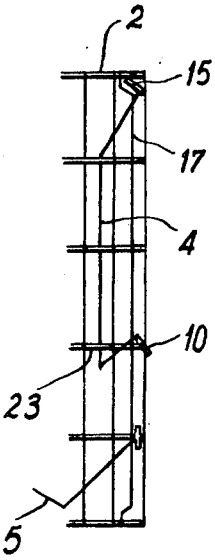
Figure 7:
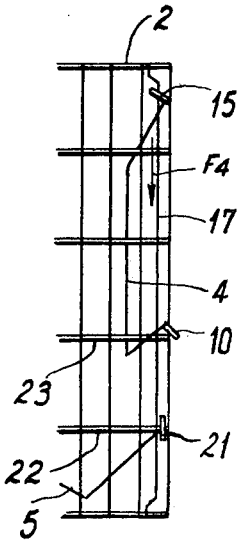

Then the panel 4 is straightened to its normal vertical position by pivoting same in the direction of the arrow F3. When this panel is in its vertical position as illustrated in FIG. 6 the hook means 15 of its upper corners can be engaged into the widened passages 19 provided at the top corners of the pair of adjacent lateral panels 2 and 3. At this point it may be emphasized that due to the length of the upper edge 24 of front panel 4, the pair of hook means 15 are located externally of the adjacent side panels 2 and 3.

Figure 8:
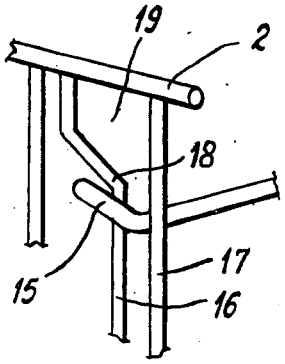
FIGS. 8 and 9 are perspective detail views showing the method of engaging certain retaining hooks in their operative positions.

With this arrangement, it is only required to cause the front panel 4 to slide downwards, as shown by the arrow F4, to being the hook means 15 into the narrowest portions of the gaps e2 formed along the front edge of the pair of lateral panels 2 and 3. Thus, these hook means, extending rearwardly and previously disposed externally of these two panels 2 and 3, will engage, and be hooked to, the external surface of the uprights 17 of said panels 2 and 3, as illustrated in FIG. 8. On the other hand, the lower hook means 10 are engaged against the external surface of the front vertical edge 16 of said lateral panels 2 and 3, as shown in FIG. 9.

With this arrangement, the front panel 4 will safely and efficiently lock the various lateral panels of the receptacle to one another. It will also be seen that the sliding movement of panel 4 is limited since the hook means 10 eventually abutes the cross members 23 of side panels 2 and 3 (see FIG. 9).

From the foregoing, it is clear that the various panels constituting the receptacle according to this invention can be assembled and interlocked very easily and rapidly, without using any additional tool or accessory. However, as already mentioned in the above description, this receptacle should by no means be construed as being strictly limited to the exemplary form of embodiment described hereinabove and illustrated in the attached drawing which shows more particularly a storage bin a rack of potatoes or other vegetables. In fact, the front wall or panel of this receptacle may be closed to constitute a conventional-type basket. In this case, the front panel may be flat or have any other configuration to suit the purpose contemplated.

Besides, the bottom panel 5 may be dispensed with so that the present receptacle can be used as a heightening device for an existing basket or as a kind of retaining chimney for miscellaneous articles or objects on sale.

Finally, it is also clear that the panels of the receptacle according to this invention may be made from solid or perforated plates or like stock instead of the wire-netting illustrated, with the various passages or apertures necessary for the coupling engagement of the assembling hook means carried by, or formed on, certain panels of the assembly.

What is claimed as new is:

1. A container comprising four lateral panels to be assembled; first hook means of predetermined length located on the vertical edges of the first panel; first passage means provided on the rear vertical edges of the second and the third panels to be disposed in front of each other on either side of said first panel; said passage means being adapted to receive said hook means and being formed of a width commensurate with the length of said hook means so that said hook means may be received in said first passage means of said second and third panels without any possibility of being inadvertently loosened therefrom; second passage means provided at a lower portion of the front vertical edges of said second and third panels; third passage means provided at an upper portion of the front vertical edges of said second and third panels, second hook means of predetermined length at each lower corner of the fourth panel, said second hook means being adapted to be received by said second passage means when said fourth panel is placed on an outwardly inclined position; third hook means of predetermined length at each upper corner of the fourth panel, said third hook means being adapted to be received by said third passage means when a sliding moment is imparted to said fourth panel after engaging the second hook means of said fourth panel with said second passage means of said second and third panels, to thereby straighten said fourth panel to its final position, said second and third passage means having such a form and width as to prevent the fourth panel with said second and third hook means inserted respectively in said second and third passage means from being extracted out of the container by inadvertently pulling said fourth panel vertically upwards.

2. A container as defined in claim 1, wherein said four lateral panels consist of metal wire-netting, the first passage means being found along the two rear vertical edges of said second and third panels, said passage means consisting of a gap existing between two successive uprights formed along said rear edges, and the width of said gaps being smaller than the length of the first hook means of the first panel, and said first passage means being closed upwards by the upper edge of said panel.

3. A container as defined in claim 1, wherein said four lateral panels consist of metal wire netting, the second passage means being formed along the lower portion of the front vertical edges of said second and third panels, said passage means consisting of a gap existing between two successive upright forms along said front edges, and the width of said gaps being smaller than the length of the second hook means of the fourth panel.

4. A container as defined in claim 1, wherein said second hook means at each lower corner of the fourth panel extend outwardly when said panel is disposed vertically in its final position, whereas said fourth hook means provided at the upper corners of said fourth panel extend inwardly of the container, said third passage means being formed at the upper portion of the front vertical edges of the second and third panels for receiving said third hook means and comprising an enlarged portion whereby said third hook means can be inserted into said third passage means when the fourth panel brought to its final vertical position, and said third passage means being closed upwards by the upper edge of the second and third panels, respectively, so that said fourth panel is firmly held in its final position.

5. A container as defined in claim 4, wherein said enlarged portion at the upper portion of said second and third panels each provided with a narrow lower extension adapted to be angaged by the corresponding hook means at the end of said downward movement of said fourth panel, said second and third panels comprising each at their lower portion a cross member adapted to act as a stop with respect to the second hook means at each lower corner of said fourth panel.

* * * * *